United States Patent [19]

Wright

[11] 4,226,415

[45] Oct. 7, 1980

[54] UNIVERSAL EXERCISE APPARATUS FOR PERFORMING HAMSTRING FLEX AND OTHER EXERCISES

[76] Inventor: Nathaniel Wright, 11247 Zorita Ct., San Diego, Calif. 92124

[21] Appl. No.: 38,435

[22] Filed: May 14, 1979

[51] Int. Cl.[3] ..... A63B 21/00

[52] U.S. Cl. ..... 272/130; 272/134; 272/DIG. 4; 272/DIG. 5

[58] Field of Search ..... 272/130, 72, 143, 144, 272/DIG. 4, DIG. 5, DIG. 1, 116, 134, 67, 93; 128/25 R

[56] References Cited

U.S. PATENT DOCUMENTS

| | | | |
|---|---|---|---|
| 3,120,954 | 2/1964 | Apostol | 272/134 X |
| 3,285,070 | 11/1966 | McDonough | 272/134 X |
| 3,495,824 | 2/1970 | Cuinier | 272/130 |
| 3,784,194 | 1/1974 | Perrine | 272/130 X |
| 4,098,502 | 7/1978 | Faust | 272/144 |

*Primary Examiner*—Richard C. Pinkham
*Assistant Examiner*—William R. Browne
*Attorney, Agent, or Firm*—Brown & Martin

[57] ABSTRACT

The exercise apparatus includes a table having a longitudinal dimension; a set of rails disposed longitudinally on opposite sides of the table; a set of posts on opposite sides of the table adjustably supported on the rails for longitudinal movement along the rails and for vertical movement extending above the rails; mechanisms for securing the posts in a fixed position on the rails. A rotary hydraulic actuator is supported on one of the posts for providing a predetermined constant resistance to rotary motion about its axis in a given direction. A bearing is supported on the post on the opposite side of the table from and axially aligned with the rotary hydraulic actuator. The apparatus has a pair of parallel arms that are adjustable in length respectfully coupled to the bearing and the rotary hydraulic actuator; and a cross bar coupled between the arms at a distance from the common axis of the bearing and the rotary hydraulic actuator for enabling a person to exercise his muscles by contacting the cross bar and forcing the cross bar to move against the predetermined constant resistance provided by the rotary hydraulic actuator. Adjustable valves are attached to the rotary hydraulic actuator for adjusting the predetermined constant resistance to movement in each given direction of rotary motion.

8 Claims, 4 Drawing Figures

UNIVERSAL EXERCISE APPARATUS FOR PERFORMING HAMSTRING FLEX AND OTHER EXERCISES

BACKGROUND OF THE INVENTION

The present invention generally pertains to exercise apparatus and is particularly directed to improvements thereto for providing an exercise apparatus that can be adjusted for use in performing a large variety of body exercises.

Body exercises are essential for conditioning muscles. Weight lifting exercises are performed to develop and maintain muscle strength and endurance. Stretching exercises are performed to develop and maintain muscle resistance to pulling and tearing. And exercises also have been devised for developing and maintaining muscle speed. Whereas muscle strength and endurance are developed and maintained by moving the largest weights that the muscles can force; muscle speed is developed and maintained by moving the lightest weights that provide substantial resistance to movement.

An apparatus has been devised for performing muscle speed development exercises. In such an apparatus a predetermined constant resistance to movement in a given direction is provided by a rotary hydraulic actuator and which is attached to a bar that is disposed for rotation against the resistance provided by the actuator. The predetermined constant resistance provided by the hydraulic actuator can be adjusted to simulate a relatively light weight, thereby enabling the performance of muscle speed development exercises. The hydraulic circuit for the hydraulic actuator also can be adjusted to simulate heavy weights to enable the performance of muscle strength and endurance exercises.

However, such apparatus is limited in the variety of exercises for which it may be used. One important exercise that cannot be performed with this equipment, or with any other commercially available exercise apparatus for that matter, is a hamstring flex exercise wherein a person in a relatively supine position pushes outward and downward against a predetermined constant resistance with the lower part of the leg from a position wherein the leg is held straight and bent as far as possible from the plane of the body at the hip. This hamstring flex exercise stretches and strengthens the hamstring muscle and thereby dimishes the likelihood of the hamstring muscle being pulled. This exercise is particularly important to athletes who do a considerable amount of running. Frequent running strengthens the quad muscle (which is the opposing muscle to the hamstring) to such an extent that hamstring pulls become more frequent due to an increased strength ratio of the quad to the hamstring.

It is the object of the present invention to provide a universed exercise apparatus which can be used to perform a large variety of muscle strength and endurance stretching and speed exercises, and that such apparatus be useful for performing the hamstring flex exercise described hereinabove.

SUMMARY OF THE INVENTION

The present invention is a universal exercise apparatus that can be used to perform a large variety of such exercises.

The exercise apparatus of the present invention includes a table having a longitudinal dimension; a set of rails disposed longitudinally on opposite sides of the table; a set of posts on opposite sides of the table adjustably supported on the rails for longitudinal movement along the rails and for vertical movement extending above the rails; mechanisms for securing the posts in a fixed position on the rails; a rotary device supported on one of the posts for providing a predetermined constant resistance to rotary motion about its axis in a given direction; a bearing supported on the post on the opposite side of the table from and axially aligned with the rotary device; a pair of parallel arms respectfully coupled to the bearing and the rotary device; and a cross bar coupled between the arms at a distance from the common axis of the bearing and the rotary device for enabling a person to exercise his muscles by contacting the cross bar and forcing the cross bar to move against the predetermined constant resistance provided by the rotary device.

Additional features of the present invention are discussed in the description of the preferred embodiment.

DESCRIPTION OF THE PREFERRED EMBODIMENT

Figure 1:
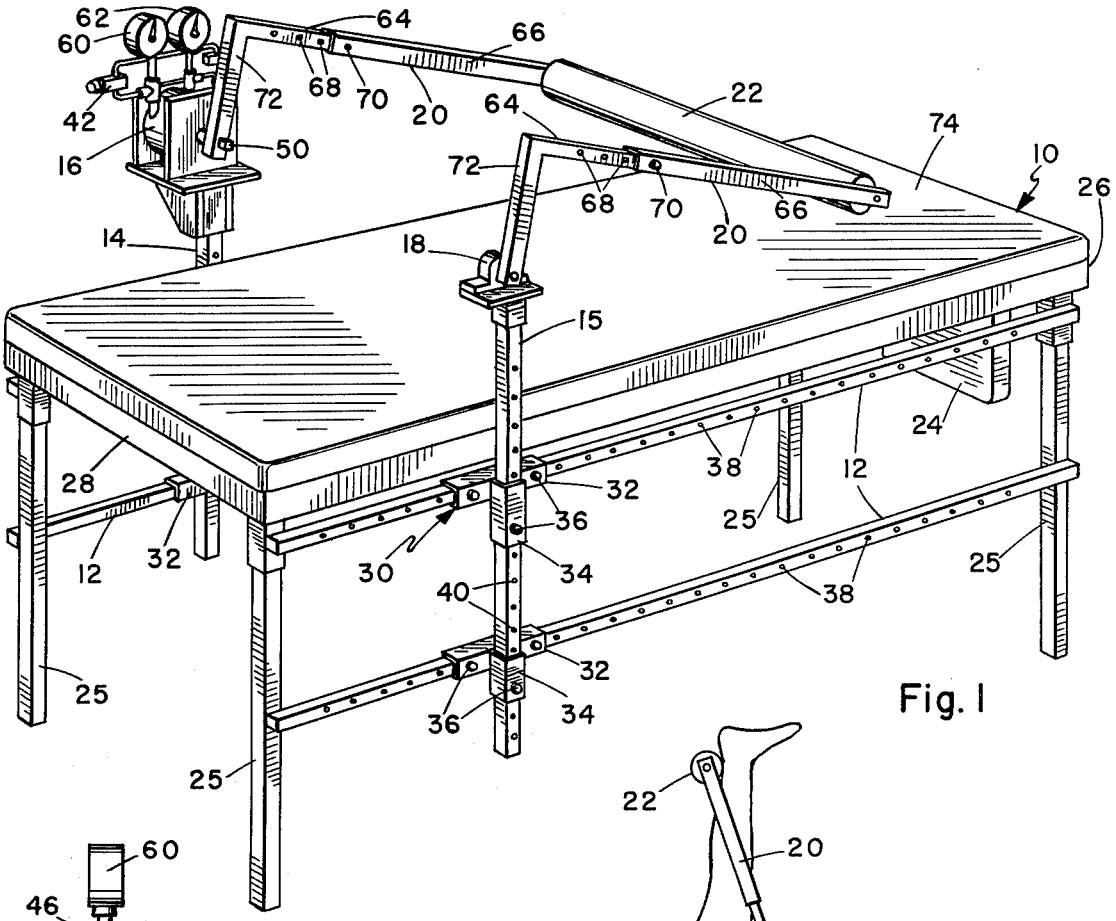
FIG. 1 is a perspective view of the exercise apparatus of the present invention.
Figure 2:
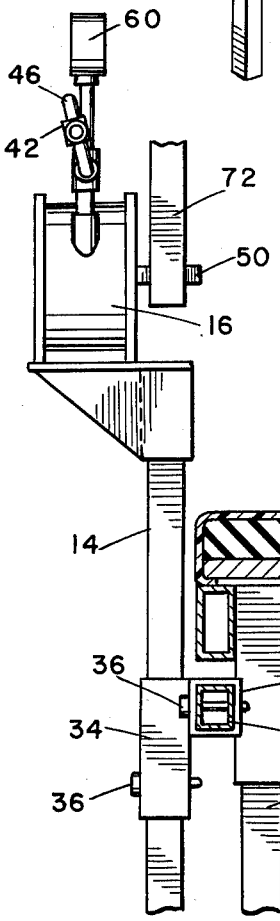
FIG. 2 is an enlarged end view of one side of the exercise apparatus, with portions cut away.

Referring to FIG. 1, the preferred embodiment of the exercise apparatus of the present invention includes a table 10, a set of rails 12, a set of posts 14, 15, a rotary hydraulic actuator 16, a bearing (included in a bearing housing 18), a pair of parallel arms 20, a cross bar 22 and a head rest 24.

The table 10 has a longitudinal dimension extending from one end 26 to the opposite end 28. The rails 12 are disposed longitudinally on opposite sides of the table 10 and are attached to the legs 25 of the table 10. The posts 14, 15 are disposed on opposite sides of the table 10 and are adjustably supported on the rails 12 for longitudinal movement along the rails 12 and for vertical movement extending above the rails 12.

A set of mechanisms 30 including a rail sleeve 32, a port sleeve 34 attached thereto, and pins 36 are used for securing the posts 14, 15 in a fixed position on the rails 12 by inserting the pins 36 through openings extending through the rail sleeve 32 and post sleeve 34 respectively, and through uniformly spaced openings 38 and 40 extending through the rails 12 and the posts 14, 15 respectively.

The rotary hydraulic actuator 16 is supported on one of the posts 14 for providing a predetermined constant resistance to rotary motion about its axis in a given direction. The bearing housing 18 is supported on the post 15 on the opposite side of the table 10 from and axially aligned with the rotary hydraulic actuator 16.

The pair of parallel arms 20 are respectfully coupled to the bearing and the rotary hydraulic actuator 16. The cross bar 22 is coupled between the arms 20 at a distance from the common axis of the bearing and the rotary hydraulic actuator 16 for enabling a person to exercise his muscles by contacting the cross bar 22 and forcing the cross bar 22 to move against the constant resistance provided by the rotary hydraulic actuator 16.

Figure 4:
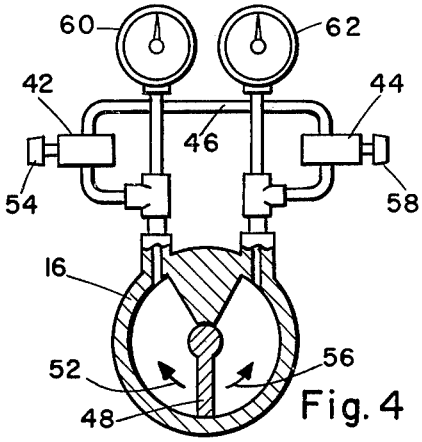
FIG. 4 shows schematically the load system for the rotary hydraulic actuator included in the exercise apparatus of FIG. 1.

Referring to FIG. 4, valves 42 and 44 are included in a hydraulic circuit 46 connected to the rotary hydraulic actuator 16 for adjusting the predetermined constant resistance to movement of the actuator vane 48 for each given direction of rotary motion. The actuator vane 48 is fixed to one end 50 of one of the parallel arms 20 (FIG. 1). The valves 42 and 44 restrict flow in only one direction and enable unrestricted flow in the opposite direction. The valve 42 restricts flow in the direction indicated by the arrow 52 in accordance with the setting of the control knob 54; and the valve 44 restricts flow in the direction indicated by the arrow 56 in accordance with the setting of the control knob 58. A gauge 60 indicates the resistance to flow in the direction indicated by the arrow 52; and a gauge 62 indicates the resistance to flow in the direction indicated by the arrow 56. By selective adjustment of the valves 42 and 44 the predetermined constant resistance to rotary motion in the direction 52 can be set to be different from the predetermined constant resistance to rotary motion in the direction 56.

The pair of parallel arms 20 are adjustable in length to enable the performance of exercises such as squat exercises that require the arms 20 to be of a greater length than for most other exercises. The arms 20 include shafts 64 and sleeves 66 for receiving the shafts 64. The ends of the sleeves 66 contain openings 67 extending therethrough, which are matched to an opposing set of uniformly spaced openings 68 extending through the shafts 64; and pins 70 are inserted through these openings to secure the shafts 64 to the sleeves 66 to provide parallel arms 20 having the desired length.

The parallel shafts 64 of the arms 20 are bent at elbows 72 to enable the cross bar 22 to be rotated to a portion that is nearly beneath one end 26 of the table 10 when the posts 14, 15 are moved to the end 26 of the table 10. It is necessary that the cross bar 22 be rotatable to such position nearly beneath the end of the table in order to perform such exercises as leg extensions.

The parallel arms 20 are bent in the preferred embodiment in order to enable the cross bar 22 to be rotated to such a position because the rotary hydraulic actuator 16 does not enable rotation over a full range of 360 degrees. A typical rotation range for a rotary hydraulic actuator is approximately 280 degrees.

The head rest 24 is hinged to the end 26 of the table 10 and is adjustable to be either folded down from the table top 74 to be positioned as an extension of the table top 74. When positioned as an extension of the table top 74, the head rest 24 enables a person to perform a bend press exercise wherein he assumes a supine position on the table top 74 with his head on the head rest 24 and his shoulders and arms free to extend below the level of the table top 74 so as to be able to push the cross bar 22 up from a position over the head rest 24.

Because the posts 14, 15 which support the cross bar 22, may be both longitudinally and vertically positioned in relation to the table top 74, it is possible to perform a large variety of muscle conditioning exercises with the exercise apparatus of the present invention in addition to the bench press exercise described above.

Figure 3:
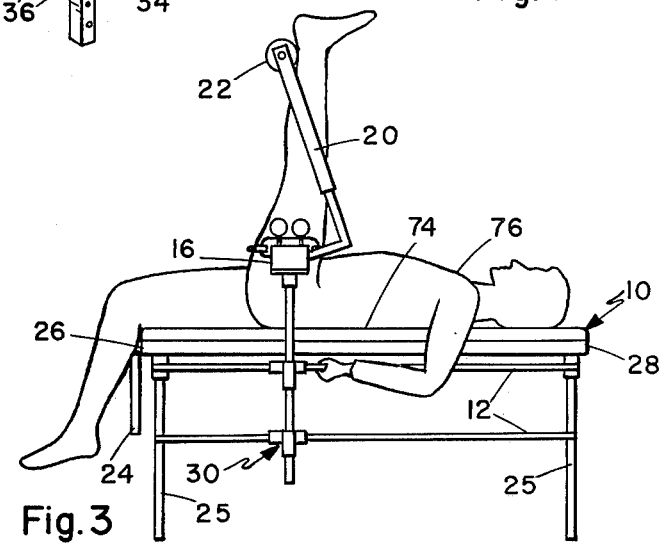
FIG. 3 schematically illustrates the use of the exercise apparatus for performing a hamstring flex exercise.

A hamstring flex exercise may be performed as shown in FIG. 3. In this exercise a person 76 in a supine position on the table 10 and bending his legs as far as possible from the hip with his leg held straight and with the lower part of his leg contacting the cross bar 11, forces the cross bar 22 away and downward against the predetermined constant resistance provided by the rotary hydraulic actuator 16.

A leg extension exercise may be performed by a person sitting on the end 26 of the table 10 and hooking his ankle underneath the cross bar 22 when it has been rotated to a position nearly beneath the end 26 of the table 10, and then raising the bar 22 against the predetermined force provided by the rotary hydraulic actuator 16.

An overhead press exercise may be performed by a person standing on the floor adjacent the end 26 of the table 10, and facing the table. The person grasps the cross bar 22 with an overhand grip when it is rotated to a position out and away from the end 26 of the table 10 and presses the cross bar upward and toward the table 10 against the predetermined constant force provided by the rotary hydraulic actuator 16.

A squat exercise may be performed by a person with his feet on the floor and facing away from the end 26 of the table 10. The cross bar is rotated to a position extending outward from the end 26 of the table 10. With his back straight and from a squat position the person contacts the cross bar 22 with his shoulders and forces the cross bar 22 upward against the predetermined constant resistance provided by the rotary hydraulic actuator 16.

A sit up exercise may be performed by a person in a supine position on the table 10 and facing the end 28 of the table 10. After the cross bar is rotated to a position against the chest of the person the person sits up while forcing the cross bar upward with his chest against the predetermined constant resistance provided by the rotary hydraulic actuator 16.

A curl flexion exercise may be performed by a person standing on the floor adjacent the end 26 of the table 10, and facing the table. The cross bar is rotated to a position out and away from the end 26 of the table 10 and at about the level of the table top 74. The person grasps the cross bar 22 from beneath with an underhand grip and lifts the bar upward against the predetermined constant resistance provided by the rotary hydraulic actuator 16.

The foregoing exercises are but a few of the large variety of exercises that can be performed with the universal exercise apparatus of the present invention.

I claim:

1. An exercise apparatus comprising a table having a longitudinal dimension;

a set of rails disposed longitudinally on opposite sides of the table;

a set of posts on opposite sides of the table adjustable supported on the rails for longitudinal movement along the rails and for vertical movement extending above the rails;

means for securing the posts in a fixed position on the rails;

a rotary means supported on one of the posts for providing a predetermined constant resistance to rotary motion about its axis in a given direction;

a bearing supported on the post on the opposite side of the table from and axially aligned with the rotary means;

a pair of parallel arms respectfully coupled to the bearing and the rotary means; and a cross bar coupled between the arms at a distance from the common axis of the bearing and the rotary means for enabling a person to exercise his muscles by contacting the cross bar and forcing the cross bar to move against the constant resistance provided by the rotary means.

2. An exercise apparatus according to claim 1, wherein the rotary means comprises a rotary hydraulic actuator coupled to one of the parallel arms for providing said predetermined constant resistance to movement of the cross bar in a given direction.

3. An exercise apparatus according to claim 2 further comprising adjustment means attached to the rotary means for adjusting the predetermined constant resistance to movement for each given direction of rotary motion.

4. An exercise apparatus according to claims 1 or 3 wherein the pair of parallel arms are adjustable in length.

5. An exercise apparatus according to claim 4, wherein the parallel arms are bent to enable the cross bar to be rotated to a position that is nearly beneath one end of the table when the posts are moved to said one end of the table.

6. An exercise apparatus according to claim 1, further comprising adjustment means attached to the rotary means for adjusting the predetermined constant resistance to movement for each given direction of rotary motion.

7. An exercise apparatus according to claim 1 wherein the parallel arms are bent to enable the cross bar to be rotated to a position that is nearly beneath one end of the table when the posts are moved to said one end of the table.

8. An exercise apparatus according to claim 1, further comprising a head rest hinged to one end of the table and adjustable to be folded down from the table top or to be positioned as an extension of the table top for enabling a person to assume a supine position on the table top with his head on the head rest and his shoulders and arms free to extend below the level of the table top in order to perform an exercise of pushing the cross bar up from a position over the head rest.

* * * * *